US009788649B2

(12) United States Patent
Bunch

(10) Patent No.: US 9,788,649 B2
(45) Date of Patent: Oct. 17, 2017

(54) STORAGE SYSTEM

(71) Applicant: DROPOUT CABINET FIXTURES, LLC, Morgan Hill, CA (US)

(72) Inventor: Clinton Merle Bunch, Morgan Hill, CA (US)

(73) Assignee: DROPOUT CABINET FIXTURES, LLC, Morgan Hill, CA (US)

( * ) Notice: Subject to any disclaimer, the term of this patent is extended or adjusted under 35 U.S.C. 154(b) by 0 days.

(21) Appl. No.: 15/494,108

(22) Filed: Apr. 21, 2017

(65) Prior Publication Data

US 2017/0224104 A1 Aug. 10, 2017

Related U.S. Application Data

(63) Continuation-in-part of application No. 15/042,016, filed on Feb. 11, 2016, now Pat. No. 9,629,454, which is a continuation-in-part of application No. 14/291,414, filed on May 30, 2014, now Pat. No. 9,282,815, which is a continuation-in-part of application No. 13/590,387, filed on Aug. 21, 2012, now Pat. No. 8,777,338, said application No. 14/291,414 is a continuation-in-part of application No. PCT/US2013/033908, filed on Mar. 26, 2013.

(60) Provisional application No. 61/685,915, filed on Mar. 27, 2012.

(51) Int. Cl.

| | |
|---|---|
| ***A47B 51/00*** | (2006.01) |
| ***A47B 46/00*** | (2006.01) |
| ***A47B 95/00*** | (2006.01) |
| ***A47B 77/10*** | (2006.01) |

(52) U.S. Cl.

CPC ..... *A47B 46/005* (2013.01); *A47B 51/00* (2013.01); *A47B 77/10* (2013.01); *A47B 95/008* (2013.01)

(58) Field of Classification Search

CPC ..... A47B 46/005; A47B 51/00; A47B 77/10; A47B 95/008; A47F 5/08

USPC ..... 312/246, 247, 248, 249.7, 272.5, 319.1, 312/319.2, 319.3, 319.7, 325

See application file for complete search history.

(56) References Cited

U.S. PATENT DOCUMENTS

| | | | |
|---|---|---|---|
| 2,769,676 | A | 11/1956 | Larsen et al. |
| 2,886,183 | A | 5/1959 | Crosby |
| 2,938,631 | A | 5/1960 | Brey |
| 3,431,040 | A | 3/1969 | Phelps et al. |
| 4,076,351 | A | 2/1978 | Wyant |
| 4,134,629 | A | 1/1979 | Hansen |

(Continued)

FOREIGN PATENT DOCUMENTS

JP 2002-223866 A 8/2002

*Primary Examiner* — James O Hansen

(74) *Attorney, Agent, or Firm* — Gordon Rees Scully Mansukhani LLP; Reid E. Dammann

(57) ABSTRACT

A storage system for storing contents is provided. The storage system includes a retractable vertical cabinet having a handle, at least one pivoting support member pivotally attached to at least an exterior side of the cabinet and a support structure. The storage system further includes a lift adjuster and a rotating adjustment screw threadably connected allowing for adjustment of a lift assist mechanism, which is connected between a foundation and the lift adjuster, to accommodate for varied loads. This storage system may also include an electric actuator movement. This storage system may also include a brake mechanism to restrain movement from any desired elevation.

20 Claims, 16 Drawing Sheets

(56) References Cited

U.S. PATENT DOCUMENTS

| | | | | |
|---|---|---|---|---|
| 4,534,601 | A | 8/1985 | Zwick | |
| 4,714,305 | A | 12/1987 | Service | |
| 4,801,142 | A | 1/1989 | Friesen | |
| 4,915,461 | A | 4/1990 | Kingsborough et al. | |
| 5,058,846 | A | 10/1991 | Close | |
| 5,127,721 | A | 7/1992 | Inden | |
| 5,224,677 | A | 7/1993 | Close | |
| 5,228,763 | A | 7/1993 | Gingold | |
| 5,249,858 | A | 10/1993 | Nusser | |
| 5,308,158 | A | 5/1994 | Vogelgesang et al. | |
| 5,560,501 | A | 10/1996 | Rupert | |
| 5,586,816 | A | 12/1996 | Geiss, II | |
| 5,758,782 | A | 6/1998 | Rupert | |
| 5,857,756 | A | 1/1999 | Fehre | |
| 5,934,615 | A | 8/1999 | Treichler et al. | |
| 6,231,138 | B1 | 5/2001 | Janson | |
| 6,247,771 | B1 | 6/2001 | Miller | |
| 7,600,831 | B2 | 10/2009 | Oh et al. | |
| 7,794,027 | B2 | 9/2010 | Calabria et al. | |
| 7,922,268 | B2 | 4/2011 | Weber | |
| 8,052,230 | B2 * | 11/2011 | Vicek | A47B 46/00 312/247 |
| 8,303,053 | B2 | 11/2012 | Bond et al. | |
| 8,414,093 | B2 | 4/2013 | Moran | |
| 8,424,983 | B1 | 4/2013 | Strauss et al. | |
| 8,641,156 | B2 * | 2/2014 | Chow | A47B 51/00 312/247 |
| 8,943,751 | B2 | 2/2015 | Ivester et al. | |
| 9,004,455 | B2 | 4/2015 | Falcon | |
| 2002/0084732 | A1 | 7/2002 | Steadman | |
| 2007/0018545 | A1 | 1/2007 | Calabria et al. | |
| 2008/0276551 | A1 | 11/2008 | Thomas et al. | |
| 2011/0266936 | A1 | 11/2011 | Moran | |

* cited by examiner

STORAGE SYSTEM

RELATED APPLICATIONS

This application is a continuation in part of U.S. Non-Provisional application Ser. No. 15/042,016 entitled "Storage System," filed on Feb. 11, 2016, and is now U.S. Pat. No. 9,629,454, which is a continuation in part of U.S. Non-Provisional application Ser. No. 14/291,414 entitled "Storage System," filed on May 30, 2014, and is now U.S. Pat. No. 9,282,815, which is a continuation in part of U.S. Non-Provisional application Ser. No. 13/590,387 entitled "Storage System," filed on Aug. 21, 2012 and is now U.S. Pat. No. 8,777,338, which claims the benefit of U.S. Provisional Application No. 61/685,915, entitled "Lowering upper cabinet pull out apparatus," filed on Mar. 27, 2012. U.S. Non-Provisional application Ser. No. 14/291,414 is also a continuation in part of Patent Cooperation Treaty Application Serial No. PCT/US13/33908 entitled "Storage System," filed on Mar. 26, 2013, which claims the benefit of U.S. Provisional Application No. 61/685,915, entitled "Lowering upper cabinet pull out apparatus," filed on Mar. 27, 2012. The contents of all related applications are hereby incorporated by reference in their entirety.

COPYRIGHT AUTHORIZATION

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

Field of the Invention

The present invention relates generally to a storage system. More particularly, the invention relates to a cabinet storage system for improving organization, accessibility and convenience of stored contents.

Discussion of the Related Art

Pull-out shelving systems and wall cabinet fillers are commonly used to store items such as spices, bottles, cans and boxes in small cabinet spaces. At times, users need to reach items in the upper portions of these systems and for most people this requires the use of a step stool or other elevating assistance. These methods are not only inadequate and inconvenient, but also hazardous. Similarly, reaching items in the cabinets located below a person's waist can be difficult, especially for those with mobility issues.

The use of objects such as step stools to assist with reaching high items is inconvenient and cumbersome. In addition, some people use poles that extend to aid in reaching upper storage areas. These types of poles are difficult to use and dangerous given the risk of dropping stored items. Further, it is important to point out that the above objects take up valuable storage space. As such, a need in the art exists to provide the ability to access generally unused space or storage areas in unreachable or difficult to reach areas, without risk or need to store objects used for the same.

DETAILED DESCRIPTION OF THE INVENTION

Figure 1:
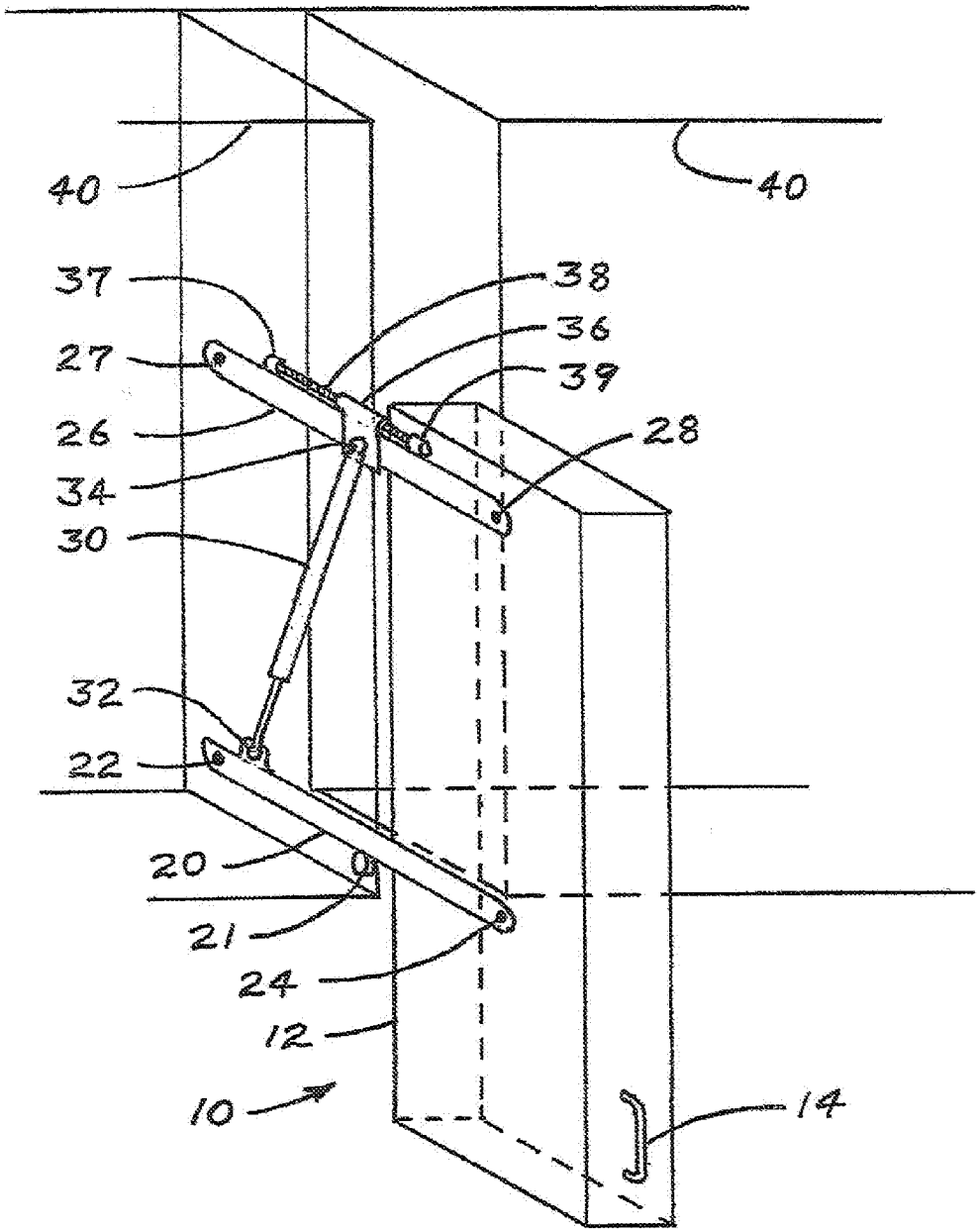
FIG. 1 is a front angled perspective view of an embodiment of a storage system in an open position.

Generally, the invention overcomes problems associated with the prior art by providing storage in areas generally out of reach to users. In one embodiment, the invention provides that stored items in difficult to reach areas are made accessible by providing a structure that allows for a retractable vertical cabinet such that a variable height and/or extension can be achieved. In another embodiment, the invention provides that stored items in difficult to reach areas are made accessible by providing a structure that allows for an isolated vertical cabinet to be raised or lowered to a convenient height. In both embodiments, the functionality allows movement in both the vertical and horizontal directions and provides the convenience and compactness needed in storage areas. Both embodiments require much less effort to access items when in the fully opened position.

The invention can be made of a variety of materials including solid materials such as wood, metal (sheet metal) and/or plastic. Further, the construction can be made to any size without losing the advantages described herein. In an embodiment, the invention can be used from 3 to 9 inches wide more or less. However, as stated, functionality of the invention is not limited by size constraints.

The invention can be constructed in a variety of ways and still maintain the advantages outlined herein. In an embodiment, the invention can be suspended by a single or two parallel pivoting support members. The pivoting support member(s) can be made of any type of material that has sufficient strength and durability, including that mentioned herein. In one embodiment, the pivoting support member(s) are attached to one side of a cabinet used for storing contents. In another embodiment, the pivoting support member(s) are attached to a link and the link is then attached to one side of a cabinet used for storing contents.

Aiding the retrieval of stored contents, in another embodiment, the pivoting support member(s) is/are connected to a lift assist mechanism. The lift assist mechanism can include springs, cables, pneumatic boosters, hydraulic boosters or electric assist movement. The pivoting support member(s) and lift assist mechanisms can be, in an embodiment, attached to the back, top and/or bottom of the retractable vertical cabinet such that the advantages outlined below are maintained.

In an embodiment using an electric actuator movement, the electric actuator movement may be mounted to a fixed cabinet 40. The electric actuator movement may include an electric motor 50, a rotating threaded shaft 52, and a swivel block. Electric motor 50 rotates threaded shaft 52, which in turn rotates through swivel block 54 at arm 26. In an embodiment, the motor 50 is activated and electrically connected to a switch 56.

In the embodiment using a spring as the lift assist mechanism; the spring is able to store what is referred to as mechanical energy in its construction. Springs are usually made out of spring steel, however some non-ferrous materials can also be used. Depending on the design and required operating environment, any material can be used to construct a spring, so long as the material has the required combination of rigidity and elasticity.

In one embodiment, the invention is directed to storage units that generally move in a bidirectional movement, e.g. arc-like movement, that extends outwardly and downward or outwardly and upward to allow easy access to items stored within the retractable vertical cabinet. In an embodiment, the invention may proceed downwardly. In another embodiment, the storage units that generally move in separate one direction movements, e.g. horizontally followed by vertically (either up or down) to allow easy access to items stored within the isolated vertical cabinet. In an embodiment, the invention may proceed upwardly. Additional benefits to the present invention are that it can be made to fit and function cleanly into custom cabinetry where space is limited. Therefore, not only does the invention allow for access to stored goods at distances difficult in reach, the storage system also is able to operate in very tight spaces and function to fit in with the design of any cabinetry.

When not in use, the storage system may be held in a closed position by spring tension or gravity alone. The storage system may also be held in a closed position by a retainer such as a latch, or the use of magnets causing retention. Thus, an advantage to the invention is that it may have additional security features such that the storage system is contained and secure.

Figure 2:
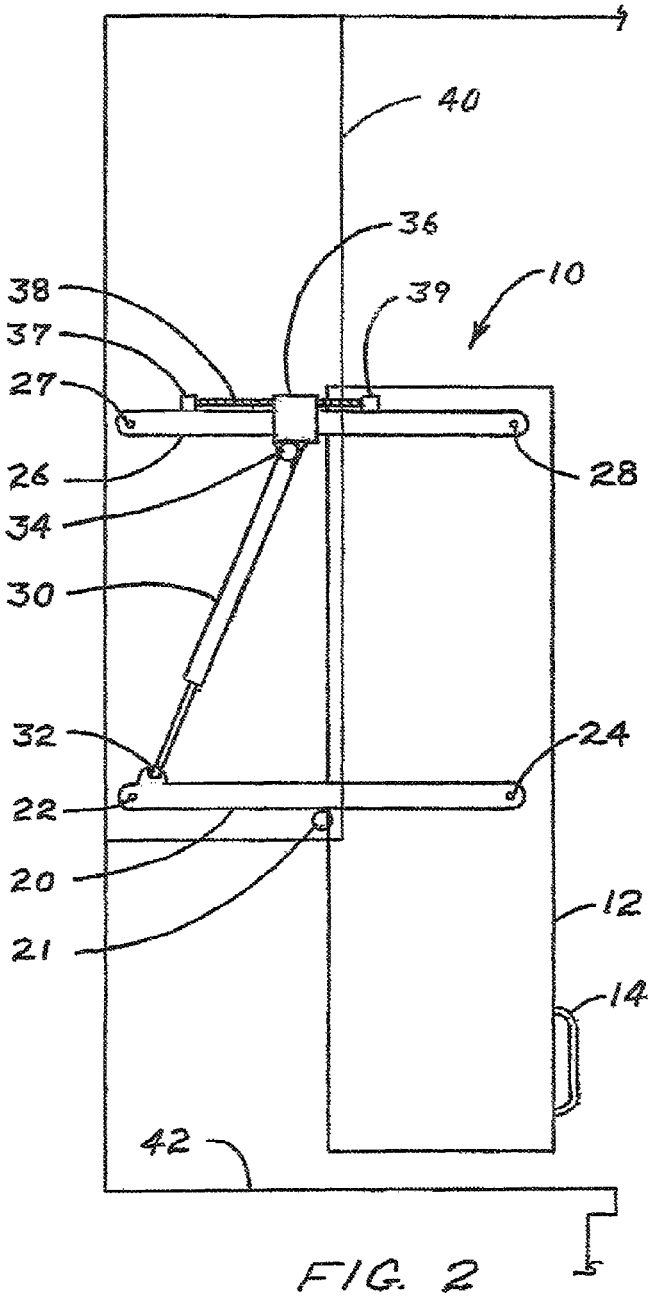
FIG. 2 is a side view of an embodiment of the storage system in an open position.
Figure 3:
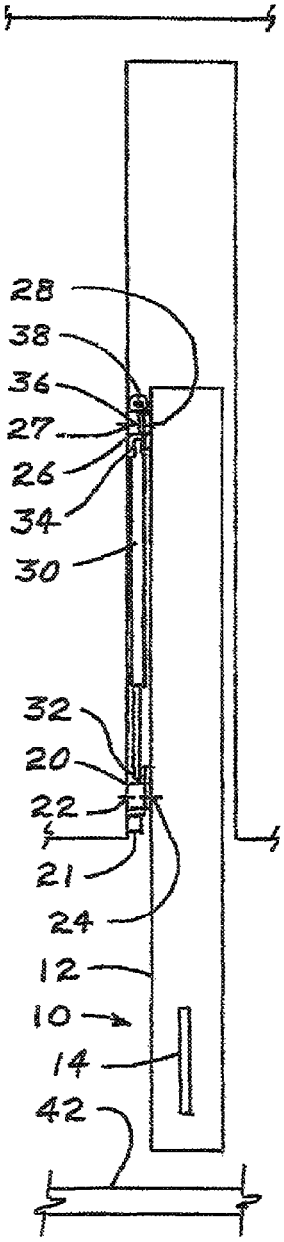
FIG. 3 is a front view of an embodiment of the storage system in the open position.
Figure 4:
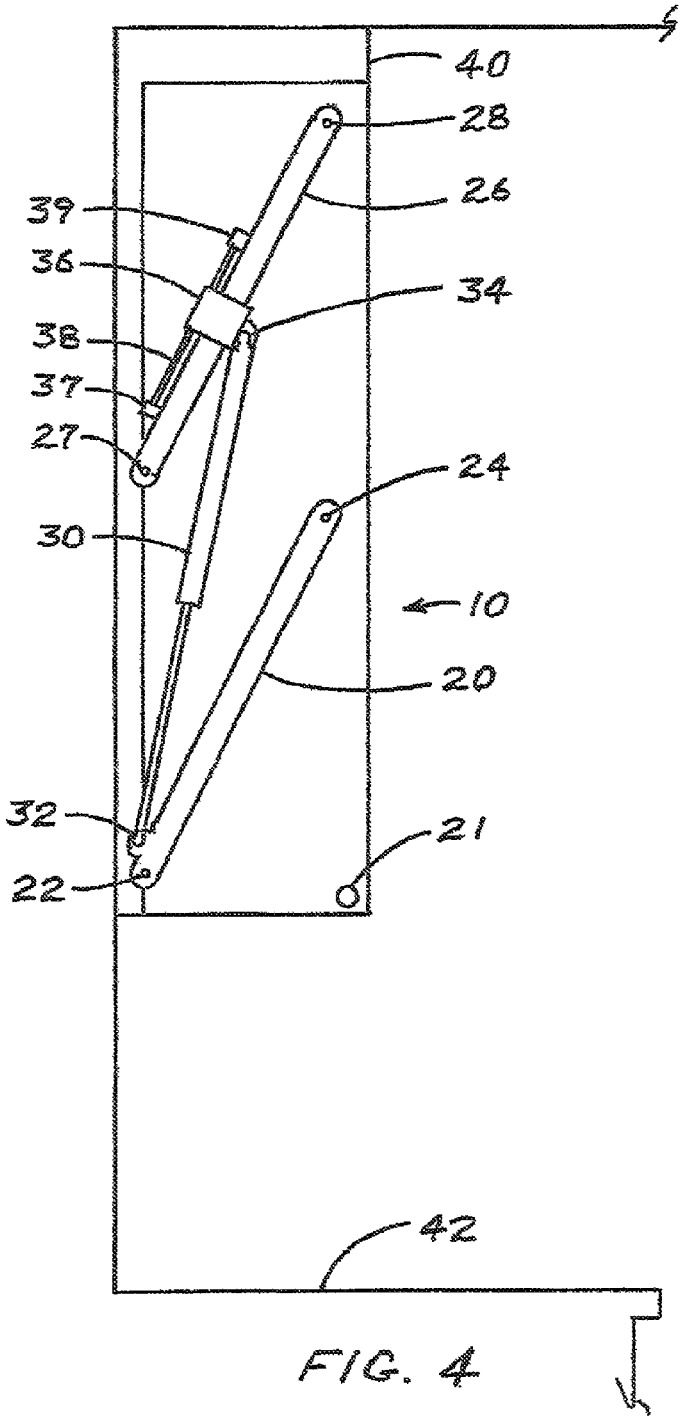
FIG. 4 is a side view of an embodiment of the storage system in a closed position.
Figure 5:
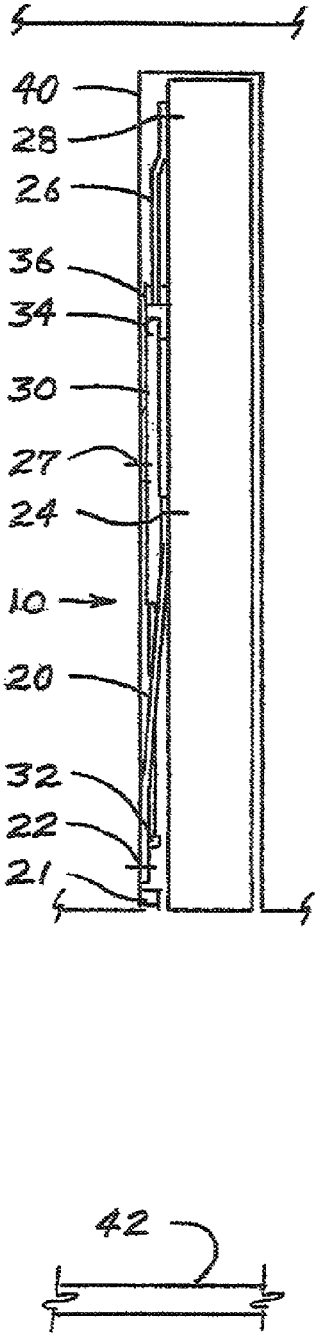
FIG. 5 is a front view of an embodiment of the storage system in the closed position.

FIGS. 1, 2 and 3 illustrate an embodiment of the storage system 10, in an open position, installed adjacent to standard wall cabinets 40. The storage system 10 is supported by a first and second pivoting support members, 20 and 26. The first and second pivoting support members, 20 and 26, are connected to a lift assist mechanism 30.

In an embodiment, the lift assist mechanism 30 can be a gas spring. A gas spring is a type of spring that uses a compressed gas contained in a cylinder, compressed by a piston, to exert a force. The gas spring can be adjustable push-in force or remote. It further can have a single touch release to allow full extension or the ability to lock it in a specific extended position.

The function of the lift assist mechanism 30 is to provide assistance in the range of motion for the storage system 10 such that the force exerted by the stored contents when the storage system 10 is in use, is tempered or reduced. It should be noted that any type of mechanism that provides or aids in lift assistance to counter the weight in contents can be used, as such the invention is not designed to be limiting in any way to gas or spring mechanisms.

FIGS. 1, 2 and 3 further illustrate a retractable vertical cabinet 12. The retractable vertical cabinet 12 includes an exterior and an interior formed by side walls. The interior can be comprised of any type of shelving configured for the items to be stored. As stated above, the retractable vertical cabinet 12 is not designed to be limited to any type of material or construction. Further, the size of the retractable vertical cabinet 12 can have varied dimensions and can otherwise depend on the space available and the specific application involved.

FIGS. 1 to 6 illustrate an embodiment, wherein the first and second pivoting support members, 20 and 26, attach to only one side of the retractable vertical cabinet 12 as installed within wall cabinet 40. In another embodiment, the first and second pivoting support members 20 and 26, are attached at a first end, either to a housing, foundation, support, or directly, to cabinets 40 at pivots 22 and 27 and to the retractable vertical cabinet 12 at pivot points 24 and 28 at a second end. The above embodiment allows for contents to be stored within the interior and otherwise be accessible to the user without having the pivoting support members, 20 and 26, as obstacles.

FIGS. 9 to 13 illustrate an embodiment of the storage system in an open position using an electric actuator movement. As stated herein, the electric actuator movement can include but is not limited to an electrical motor 50 wherein the electrical actuator is mounted to the fixed cabinet 40. The electric actuator movement includes the rotating threaded shaft 52, and is driven by motor 50 and rotates through swivel block 54 at arm 26. In an embodiment, the motor 50 is activated and electrically connected to a switch 56. Different constructions are available without departing from the advantages of the invention. In an embodiment, the invention can include a plurality of first and second pivoting support members which connect to a plurality of side walls of any retractable vertical cabinet 12. The type of construction and placement of the pivoting support members would depend on the construction of the retractable vertical cabinet 12 as well as the space being used.

The structure supporting the retractable vertical cabinet 12 includes a plurality of components. More clearly seen in FIG. 2, as stated above, the pivoting support members 20 and 26 are connected to the lift assist mechanism 30 at attachment points 32 and 34, and form the base for the support. Attachment points 32 and 34 can comprise any type of fastener such as a screw or bolt, as long as the connection allows for a pivot relationship between the two structures. In an embodiment, attachment point 34 is a part of a lift adjuster 36 which is adjustable on the first pivoting support member 26 by means of a rotating adjustment screw 38. The features and characteristics of the lift adjuster 36 are further described below.

FIGS. 1, 2 and 3 further illustrate a stop 21. The degree in which the retractable vertical cabinet 12 extends out and in an embodiment, down, is limited by the first and second pivoting support members 20 and 26, in an embodiment. The stop 21 prevents over extension, and in an embodiment, downward extension, of the retractable vertical cabinet 12 when pulled out, which would otherwise damage components of the storage system 10 or adjacent cabinetry. In an embodiment, the stop 21 is attached to either a housing or adjacent cabinet 40.

The stop 21 also performs a function as a guide. It assists with the alignment of the retractable vertical cabinet 12 when in use. Typically, the stop 21 can be made of rubber or plastic, however, other materials may be used such that when in contact with the second support member 20 integrity is maintained.

In an embodiment, the storage system 10 is manually operated by a handle 14 attached to the retractable vertical cabinet 12. However, any means can be used which allows a user to engage the retractable vertical cabinet 12 according to the movements discussed herein. These can include a variety and number of protrusions attached to the retractable vertical cabinet 12. Generally, this feature is determined by the end consumer's preference, as is the front trim panel to match cabinets 40 or the like.

FIG. 3 is a frontal view illustrating the retractable vertical cabinet 12 in the open position. In use, or in the open position, the user has pulled out the retractable vertical cabinet 12 by the handle 14, effectively activating the lift assist mechanism 30. The contents in the retractable vertical cabinet 12 operate as the load. In the spring embodiment of the lift assist mechanism 30, mechanism can be a coiled or torsion spring. The load then compresses (or stretches) the spring (in the case of a gas spring, the gas is compressed) on pulling down the retractable vertical cabinet 12. The force it exerts is proportional to its change in length. An extension or compression spring has units of force divided by distance, for example lbf/in or N/m. Torsion springs have units of force multiplied by distance divided by angle, such as N·m/rad or ft·lbf/degree. In any event, the effect is the allowance of force in putting the storage system 10 in its closed position, illustrated in FIGS. 4 and 5.

As stated above, the lift assist mechanism 30 is connected to lift adjuster 36 at attachment point 34. The lift adjuster 36 is connected to a rotating adjustment screw 38. The rotating adjustment screw 38 is supported by a first and second idler, 37 and 39, respectively. The first and second idlers, 37 and 39, house and support the rotating adjustment screw 38. In an embodiment, the connection between the two structures is threaded. Further, in another embodiment, the first and second idlers, 37 and 39, are bonded or otherwise adhered to the first pivoting support member 26 to provide stability for movement of the same.

The lift adjuster 36 is moved by rotating adjustment screw 38. This movement effectively increases or decreases leverage against the lift assist mechanism 30. This movement provides versatility and allows the support structure to accommodate varying weight loads in the retractable vertical cabinet 12.

Figure 6:
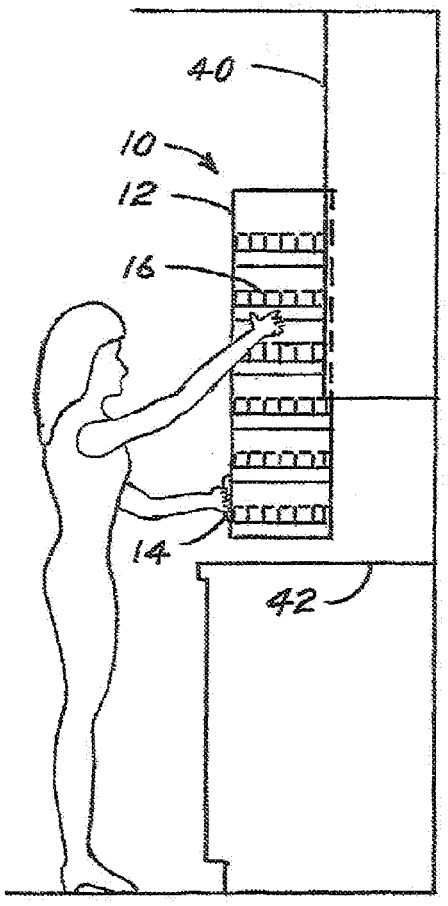
FIG. 6 is a side view of an embodiment of the storage system in an open position as it is used by a user.
Figure 7:
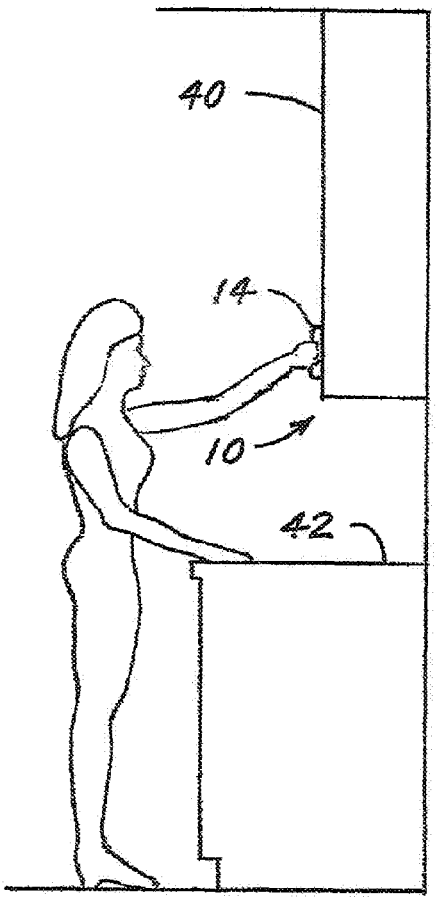
FIG. 7 is a side view of an embodiment of the storage system in a closed position as it is used by a user.
Figure 8:
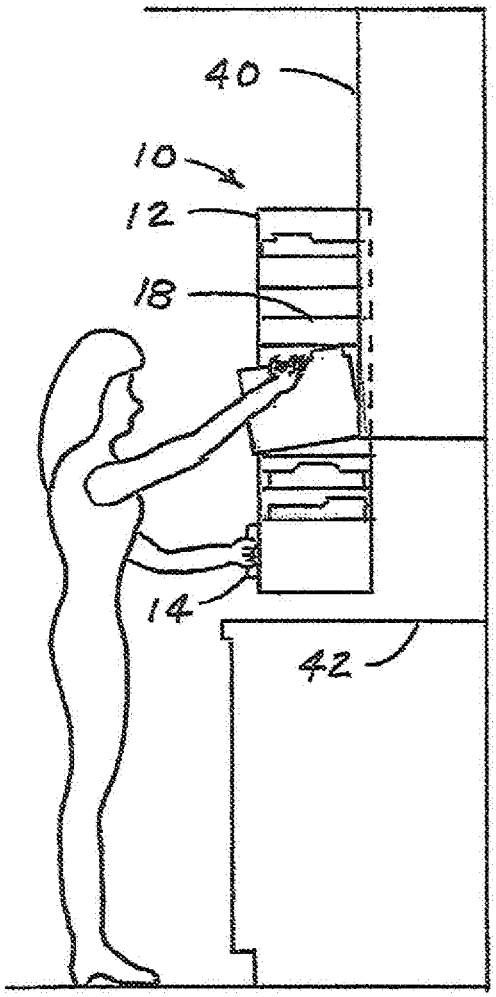
FIG. 8 is a side view of an alternative embodiment of the storage system.
Figure 9:
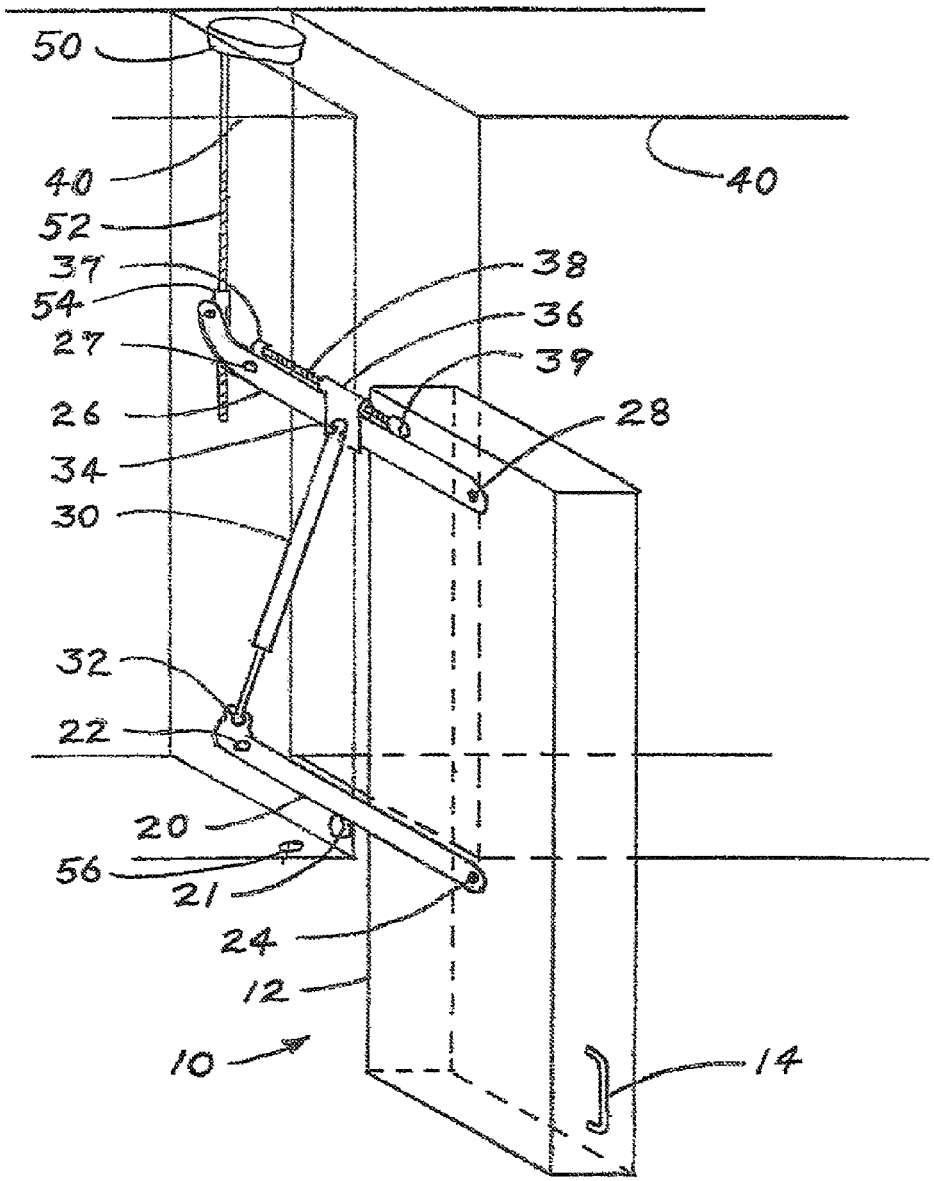
FIG. 9 is a front angled perspective view of an embodiment of a storage system in an open position using an electric actuator movement.
Figure 10:
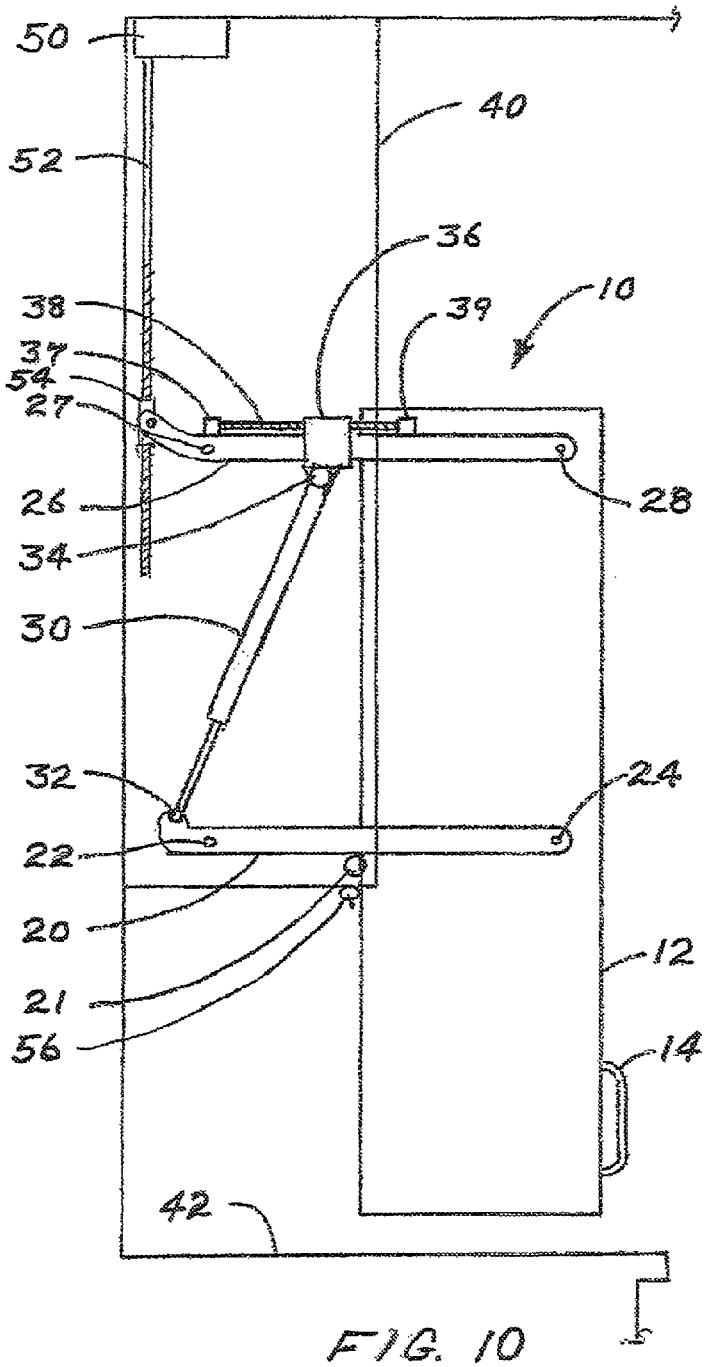
FIG. 10 is a side view of an embodiment of the storage system in an open position using an electric actuator movement.
Figure 11:
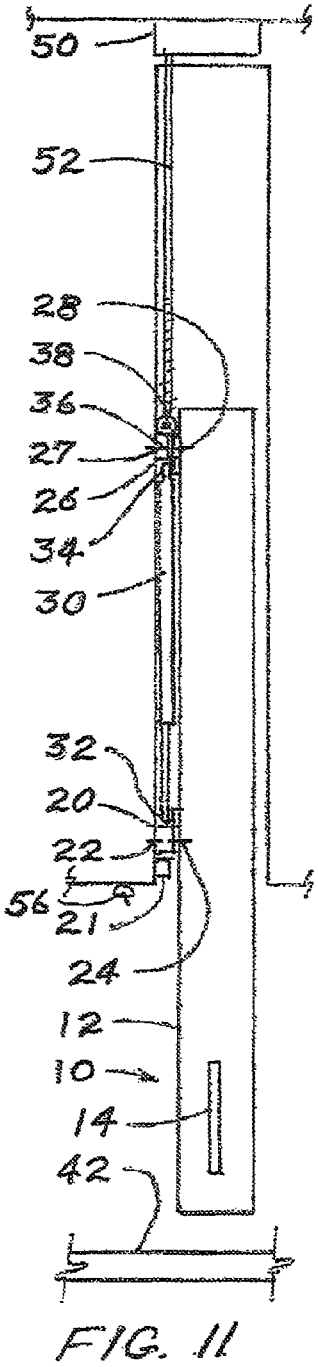
FIG. 11 is a front view of an embodiment of the storage system in the open position using an electric actuator movement.
Figure 12:
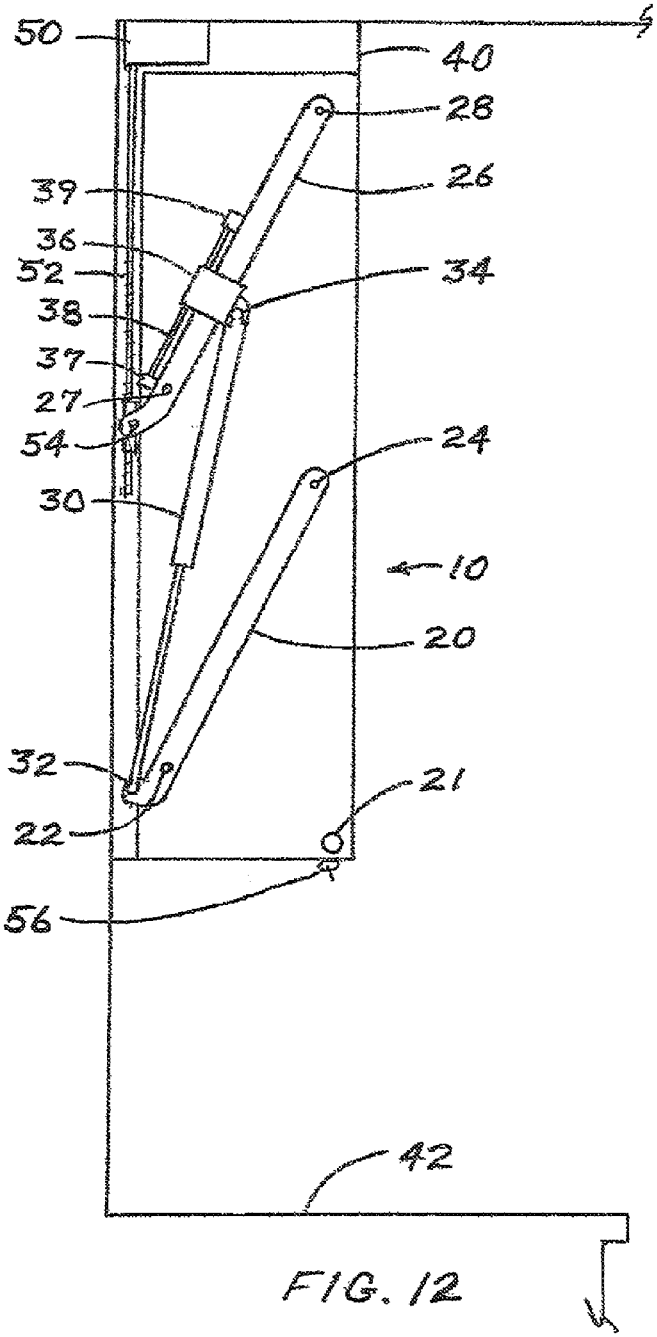
FIG. 12 is a side view of an embodiment of the storage system in a closed position using an electric actuator movement.
Figure 13:
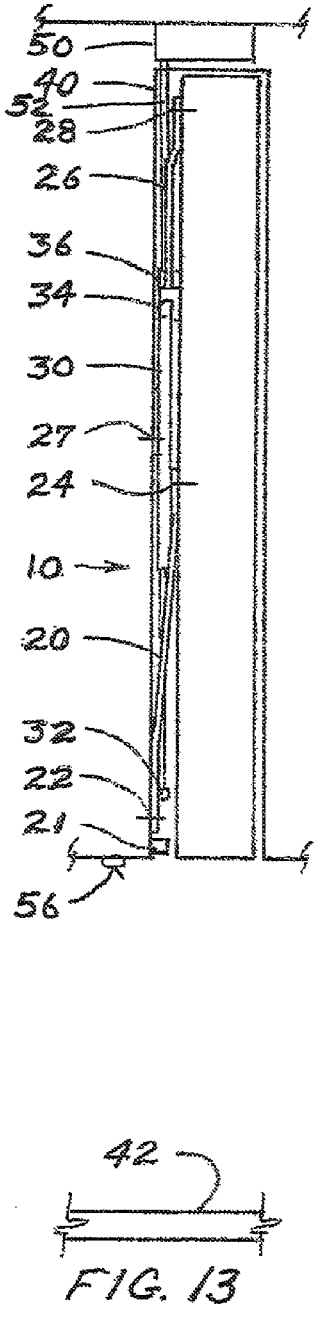
FIG. 13 is a front view of an embodiment of the storage system in the closed position using an electric actuator movement.

FIG. 6 illustrates an embodiment of the storage system 10. Specifically, the retractable vertical cabinet 12 can include a variety of different structures to house various contents. In this embodiment, the retractable vertical cabinet 12 includes a tray configuration 16 that may house structures to hold spices or other similar structures. Similarly, FIG. 8 illustrates an alternative embodiment of the retractable vertical cabinet 12. In this embodiment, the retractable vertical cabinet 12 is structured to house files in a folder holder configuration 18. In both cases, FIG. 7 illustrates the retractable vertical cabinet 12 in its retracted state.

As stated, the storage system 10 allows for making use of generally unusable or difficult to reach spaces. The system 10 allows for the storage and retrieval of contents in a manner that is easy and efficient without having to go through the hazardous and cumbersome techniques outlined herein.

An advantage of the storage system 10 is the lift assist mechanism 30. This mechanism balances the load present in the retractable vertical cabinet 12 and provides force to aid the user in pulling out and down, as well as pushing up and in, the retractable vertical cabinet 12, in a single motion.

A further advantage of the storage system 10 is the attachment of the lift assist mechanism 30 and the first and second pivoting support members, 26 and 20, to a side of the retractable vertical cabinet 12. This allows for retrieval of contents in spaces generally unusable in normal cabinetry without impeding access to stored contents.

Another advantage of the storage system 10 is the ability to accommodate various loads placed in the retractable vertical cabinet 12 by the user. This advantage is made possible by the lift adjuster 36 being threadably connected to the rotating adjustment screw 38. These features allow for the movement of the lift mechanism 30 along the first pivoting support member 26 resulting in various degrees of force exerted by the mechanism 30.

Another embodiment of the storage system 10 is the versatility that can be employed by the retractable vertical cabinet 12. As described above, FIGS. 6 and 8 illustrate a configuration of the retractable vertical cabinet 12 that can house various structures of food stuffs in a tray configuration 16. Alternatively, the retractable vertical cabinet 12 can house documents in a folder holder configuration 18. As such, the retractable vertical cabinet 12 can be constructed to house a multitude of items to be stored.

Figure 14:
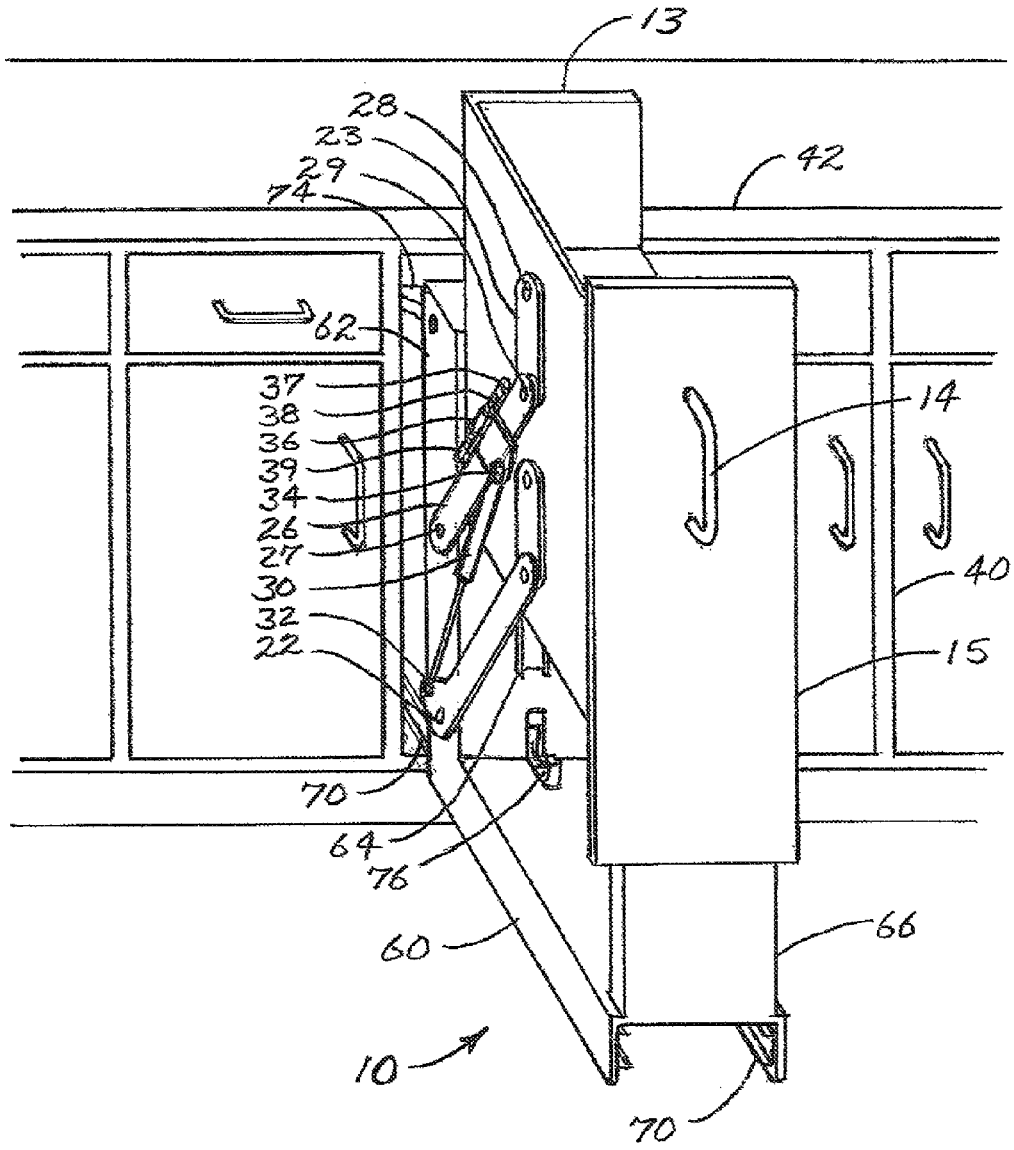
FIG. 14 is perspective view of an embodiment of the storage system in an open and raised position.
Figure 15:
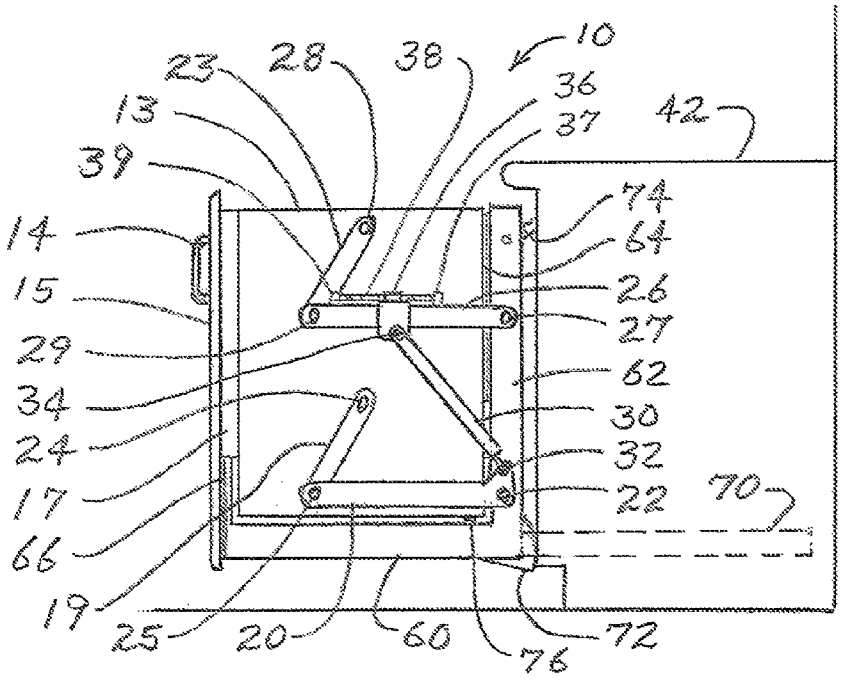
FIG. 15 is a side view of an embodiment of the storage system in an open an open and lowered position.
Figure 16:
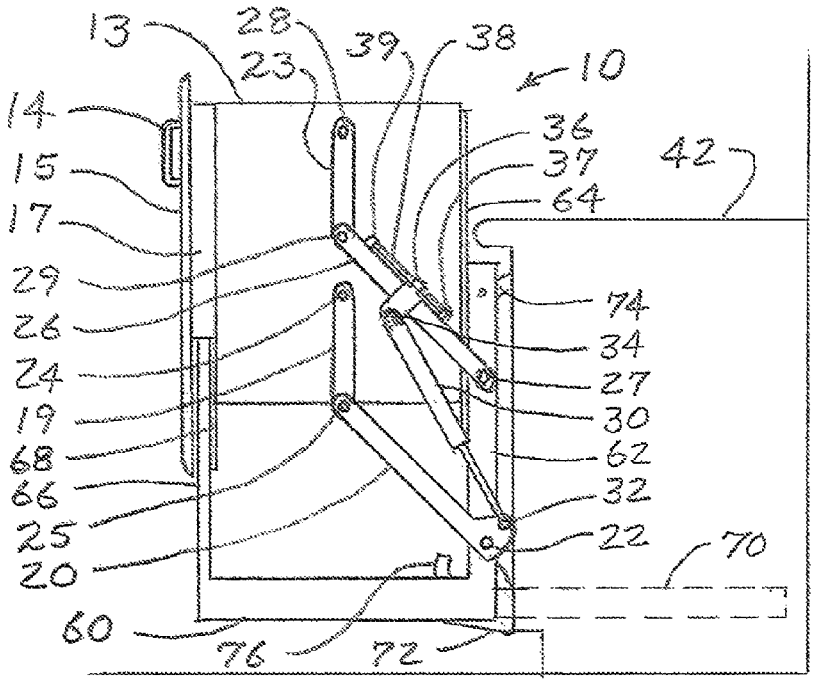
FIG. 16 is a side view of an embodiment of the storage system in an open and raised position.
Figure 17:
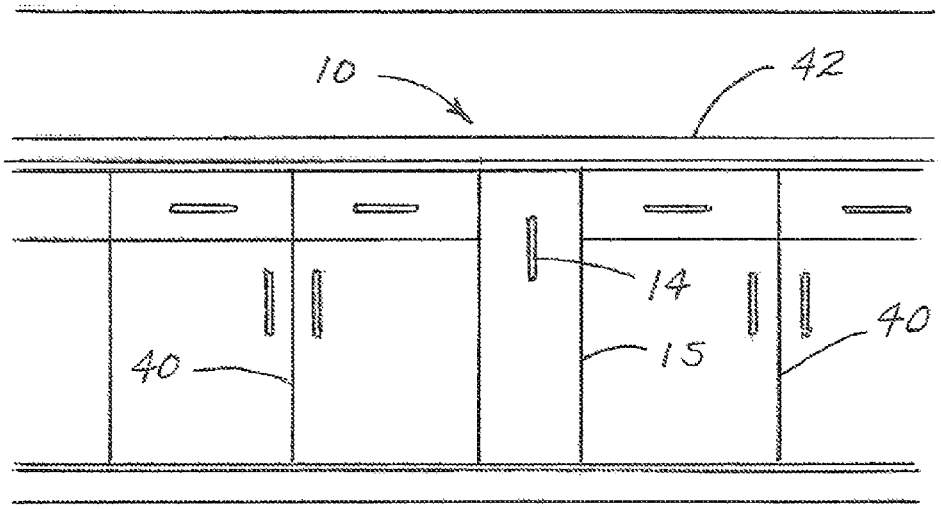
FIG. 17 is a front view of an embodiment of the storage system in a closed position.
Figure 18:
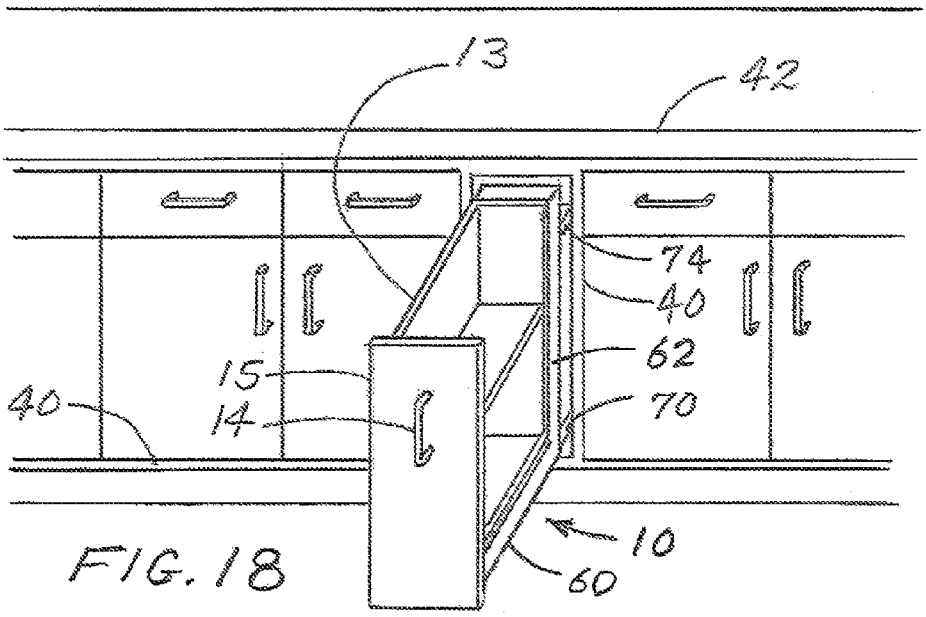
FIG. 18 is a perspective view of an embodiment of the storage system in an open and lowered position.

FIGS. 14 to 16 illustrate an embodiment of storage system 10 having an isolated vertical movement in an open position viewed from the lift mechanism side. FIGS. 14 and 16 shows the storage system in an elevated position. FIG. 15 shows the storage system in a lowered position. In the figures, storage system 10 is shown as installed with standard cabinets 40. The storage system 10 is extended forward from standard cabinets 40 on horizontal slides 70. When fully extended, storage system 10 can be elevated by moving handle 14 vertically thus extending vertical slides 64 and 66 and elevating isolated vertical cabinet 13. The vertical movement of cabinet 13 trips lock actuator 76 and engages horizontal lock 72 and stability guide 74. When horizontal frame 60 is less than fully extended from within cabinets 40, horizontal lock 72 functions as a safety stop keeping lock actuator 76 in the locked position and retaining cabinet 13 in the fully down position. When lock actuator 76 is tripped, horizontal lock 72 extends down in front of standard cabinet 40 and stability guide 74 extends back into the opening in standard cabinet 40 to stabilize the top of the isolated vertical cabinet.

Vertical frame 62 is rigidly attached to horizontal frame 60 and is the foundation for stability guide 74 as well as pivoting support members 20 and 26 which are attached to vertical frame 62 at pivot 22 and 27. Vertical slide 64 is attached to vertical frame 62 on its fixed side while the moving side of vertical slide 64 is attached to isolated vertical cabinet 13. Vertical slide 68 is attached to vertical frame 66 on its fixed side while the moving side of vertical slide 68 is attached to isolated vertical cabinet 13. Handle 14 is attached to front panel 15 which is attached to panel attachment sleeve 17 that is attached to isolated vertical cabinet 13. Vertical frame 66 has free passage through sleeve 17.

Pivoting support members 20 and 26 transfer lift assist force to isolated vertical cabinet 13 at pivots 24 and 28 through links 19 and 23 which connect to pivoting support member 20 and 26 at pivots 25 and 29. The pivoting support members 20 and 26 are connected to lift assist mechanism 30.

In an embodiment, the lift assist mechanism 30 can be a gas spring. A gas spring is a type of spring that uses a compressed gas contained in a cylinder, compressed by a piston, to exert a force. The gas spring can be adjustable push-in force or remote. It further can have a single touch release to allow full extension or the ability to lock it in a specific extended position.

The function of the lift assist mechanism 30 is to provide assistance in the range of motion for the storage system 10 such that the force exerted by the stored contents when the storage system 10 is in use, is tempered or reduced. It should be noted that any type of mechanism that provides or aids in lift assistance to counter the weight in contents can be used, as such the invention is not designed to be limiting in any way to gas or spring mechanisms.

FIGS. 14, 15, and 16 further illustrate an isolated vertical cabinet 13. The isolated vertical cabinet 13 includes an exterior and an interior formed by side walls. The interior can be comprised of any type of shelving configured for the items to be stored. As stated above, the isolated vertical cabinet 13 is not designed to be limited to any type of material or construction. Further, the size of the isolated vertical cabinet 13 can have varied dimensions and can otherwise depend on the space available and the specific application involved.

FIGS. 14 to 19 illustrate an embodiment, wherein the first and second pivoting support members, 26 and 20, attach to only one side of the isolated vertical cabinet 13 as installed within cabinet 40. The above embodiment allows for contents to be stored within the interior and otherwise be accessible to the user without having the pivoting support members, 20 and 26, as obstacles.

Different constructions are available without departing from the advantages of the invention and placement of the pivoting support members would depend on the construction of the isolated vertical cabinet 13 as well as the space being used.

The structure supporting the isolated vertical cabinet 13 includes a plurality of components. More clearly seen in FIGS. 15 and 16 as stated above, the pivoting support members 20 and 26 are connected to the lift assist mechanism 30 at attachment points 32 and 34, and form the base for the support. Attachment points 32 and 34 can comprise any type of fastener such as a screw or bolt, as long as the connection allows for a pivot relationship between the two structures. In an embodiment, attachment point 34 is part of a lift adjuster 36 which is adjustable on the first pivoting support member 26 by means of a rotating adjustment screw 38. The features and characteristics of the lift adjuster 36 are further described below.

In an embodiment, the storage system 10 is manually operated by a handle 14 attached to the isolated vertical cabinet 13. However, any means can be used which allows a user to engage the isolated vertical cabinet 13 according to the movements discussed herein. These can include a variety and number of protrusions attached to the isolated vertical cabinet 13. Generally, this feature is determined by the end consumer's preference, as is the front panel 15 to match cabinets 40 or the like.

Figure 19:
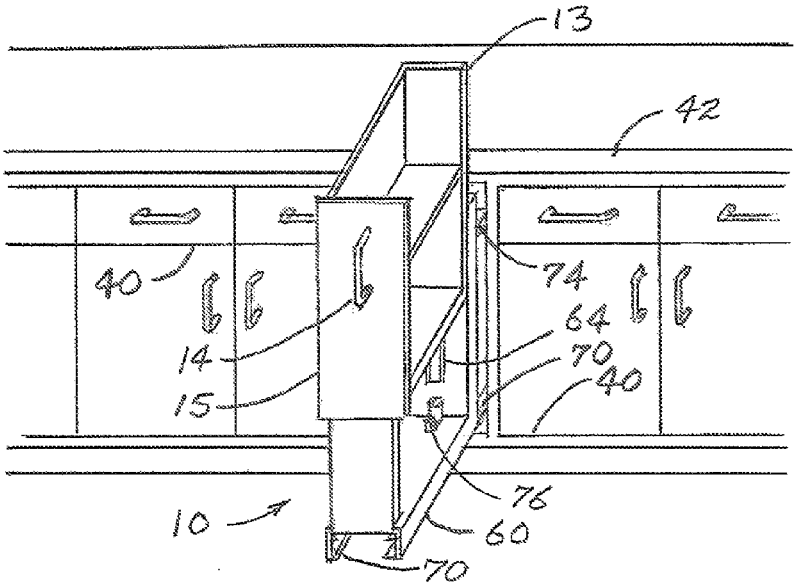
FIG. 19 is a perspective view of an embodiment of the storage system in an open and raised position.

FIG. 19 is a view illustrating the isolated vertical cabinet 13 in the open position. In use, or in the open position, the user has pulled out and up the isolated vertical cabinet 13 by the handle 14, effectively activating the lift assist mechanism 30. The contents in the isolated vertical cabinet 13 operate as the load. In the spring embodiment of the lift assist mechanism 30, mechanism can be a coiled or torsion spring. The load then compresses (or stretches) the spring (in the case of a gas spring, the gas is compressed) on pulling down the isolated vertical cabinet 13. The force it exerts is proportional to its change in length. An extension or compression spring has units of force divided by distance, for example lb/in or N/m. Torsion springs have units of force multiplied by distance divided by angle, such as N-m/rad or ft-lb/degree. In any event, the effect is the allowance of force in putting the storage system 10 in its elevated open position, illustrated in FIGS. 14, 16, and 19.

As stated above, the lift assist mechanism 30 is connected to lift adjuster 36 at attachment point 34. The lift adjuster 36 is connected to a rotating adjustment screw 38. The rotating adjustment screw 38 is supported by a first and second idler, 37 and 39, respectively. The first and second idlers, 37 and 39, house and support the rotating adjustment screw 38. In an embodiment, the connection between the two structures is threaded. Further, in another embodiment, the first and second idlers, 37 and 39, are bonded or otherwise adhered to the first pivoting support member 26 to provide stability for movement of the same.

The lift adjuster 36 is moved by rotating adjustment screw 38. This movement effectively increases or decreases leverage against the lift assist mechanism 30. This movement provides versatility and allows the support structure to accommodate varying weight loads in the isolated vertical cabinet 13.

Another advantage of the storage system 10 is the ability to accommodate various loads placed in the isolated vertical cabinet 13 by the user. This advantage is made possible by the lift adjuster 36 being threadably connected to the rotating adjustment screw 38. These features allow for the movement of the lift mechanism 30 along the first pivoting support member 26 resulting in various degrees of force exerted by the mechanism 30.

Another embodiment of the storage system 10 is the versatility that can be employed by the isolated vertical cabinet 13. As described above, FIGS. 18 and 19 illustrate a configuration of the isolated vertical cabinet 13 that can house various structures of food stuffs in a tray configuration 16. Alternatively, the isolated vertical cabinet 13 can house tools, objects and supplies. As such, the isolated vertical cabinet 13 can be constructed to house a multitude of items to be stored.

Figure 20:
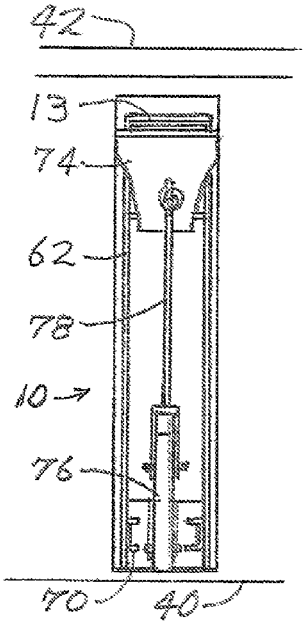
FIG. 20 is an inside back view of an embodiment of the storage system.
Figure 21:
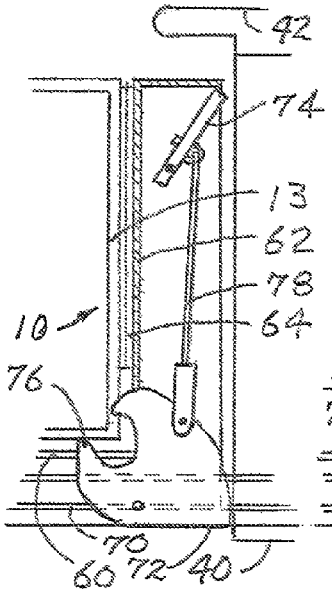
FIG. 21 is a partial section view of vertical frame 62 showing the lock actuator in the down locked position.
Figure 22:
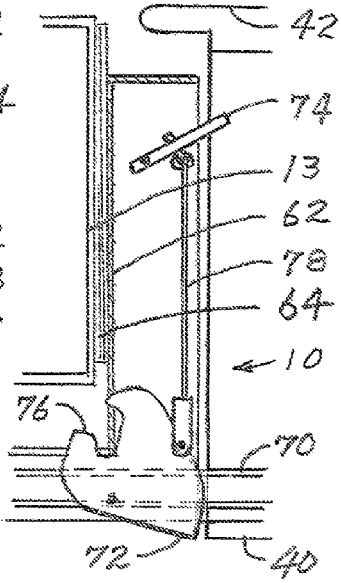
FIG. 22 is a partial section view of vertical frame 62 showing the lock actuator in the up locked position.

FIGS. 20, 21, and 22 illustrate an embodiment of the locking and stability mechanism as contained within vertical frame 62. In the down/locked position the isolated vertical cabinet 13 is free to move horizontally into and out of standard cabinets 40. As shown in FIGS. 20 and 21 isolated vertical cabinet 13 is held in the down/locked position by lock actuator 76 and cannot be released until horizontal lock 72 has been fully retracted from cabinet 40, thus allowing free movement of lock actuator 72. The upward motion of the isolated vertical cabinet 13 releases lock actuator 76 and engages horizontal lock 72 as viewed in FIG. 22, stopping horizontal movement and allowing free vertical movement. Once isolated vertical cabinet 13 has been fully lowered, lock actuator 76 locks the isolated vertical cabinet 13 in the down position and retracts horizontal lock 72, once again allowing free horizontal movement.

Figure 23:
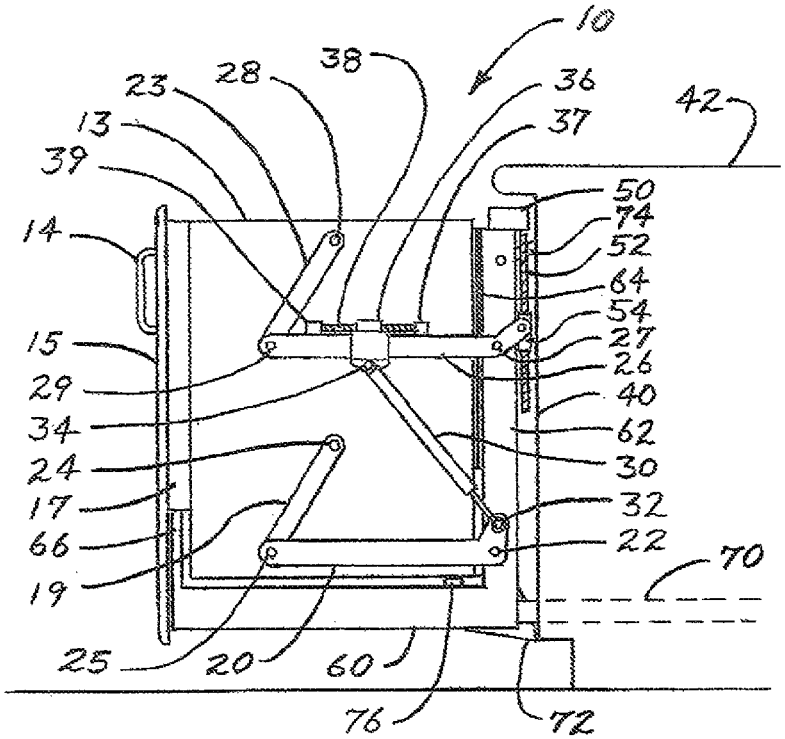
FIG. 23 is a side view of an embodiment of the storage system in an open and lowered position using an electric actuator movement.

FIG. 23 illustrates an embodiment incorporating an electric actuator movement on storage units employing isolated vertical movement. In this embodiment, the electric actuator movement includes motor 50, threaded shaft 52, and swivel block 54. Threaded shaft 52 is attached to motor 50 at one end and passes through swivel block 54. Swivel block 54 is attached to pivoting support member 26. Electrical motor 50 is attached to the vertical support frame 62. Electrical motor 50 rotates threaded shaft 52, which in turn raises or lowers swivel block 54 depending on the rotation direction. Swivel block 54 in turn raises or lowers pivoting support member 26.

Figure 24:
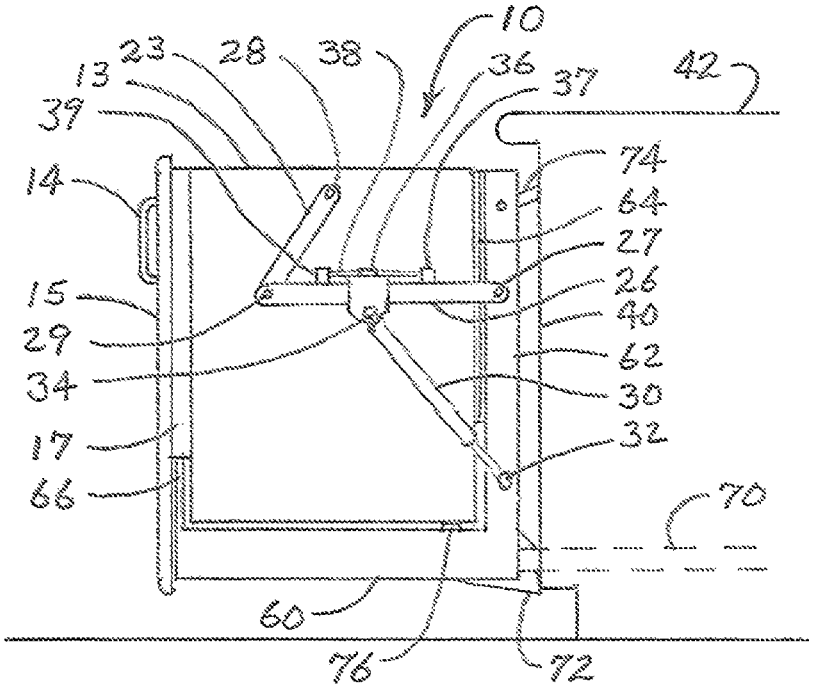
FIG. 24 is a side view of an alternate embodiment of the storage system in an open and lowered position.
Figure 25:
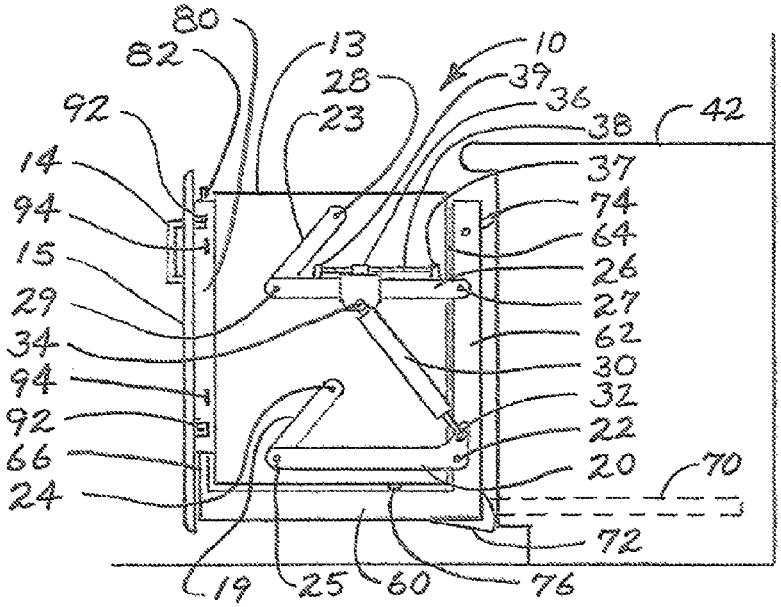
FIG. 25 is a side view of an embodiment of the storage system in open and lowered position with a vertical lock system.

FIG. 24 illustrates an embodiment with only one pivoting support member. In this embodiment, the lift assist mechanism attaches to the pivoting support member 26 via lift adjustor 36 at attachment point 34. The lift assist mechanism also attaches to vertical frame 62 at attachment point 32. Alternatively, the lift assist mechanism could attach to horizontal frame 60. An electric actuator movement may also be employed in this embodiment.

Figure 26:
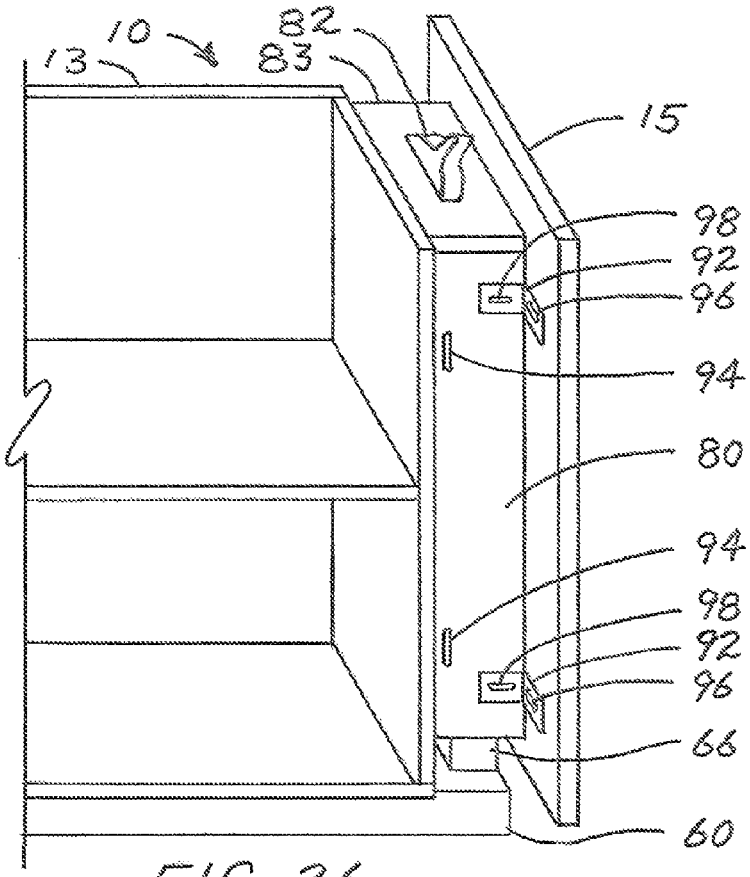
FIG. 26 is a partial perspective view of an embodiment showing the vertical lock system and panel adjustment provisions.
Figure 27:
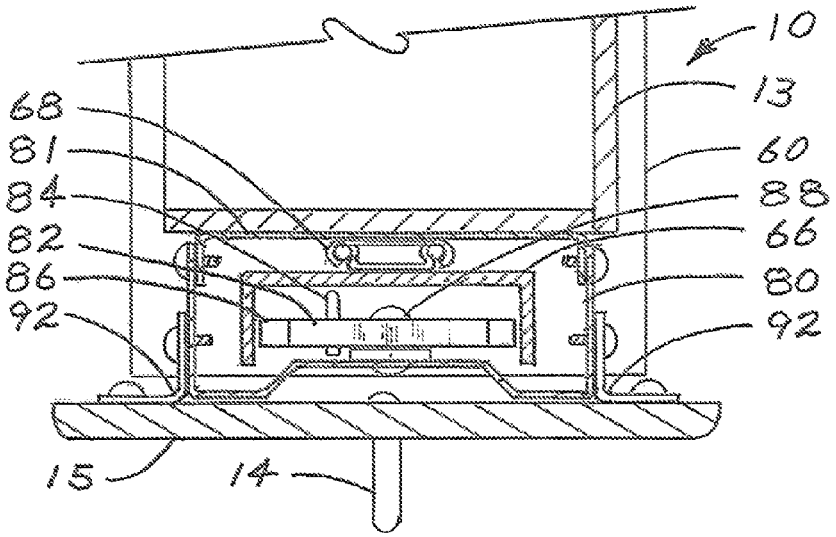
FIG. 27 is a partial top view section of an embodiment of the vertical lock system.

FIGS. 25 to 30 illustrate an embodiment incorporating a vertical lock system to control the up or down movement of the isolated vertical cabinet 13. In the embodiment illustrated, the mechanism of the vertical lock system is located near vertical frame 66, within a lock housing unit. The lock housing unit includes a front 80, a back 81, and a cap 83. In this embodiment, vertical frame 66 has a generally U-shape configuration as illustrated in FIG. 27. In this embodiment, housing unit takes the place of the panel attachment sleeve 17. In other embodiments, the vertical frame 66 is not U-shaped. In other embodiments, vertical frame 66 is any shape that will accommodate the vertical lock system. In other embodiments, the mechanism of the vertical lock system is located near vertical frame 62. In this embodiment, vertical frame 62 may be U-shaped or any other shape that will accommodate the vertical lock system.

Figure 28:
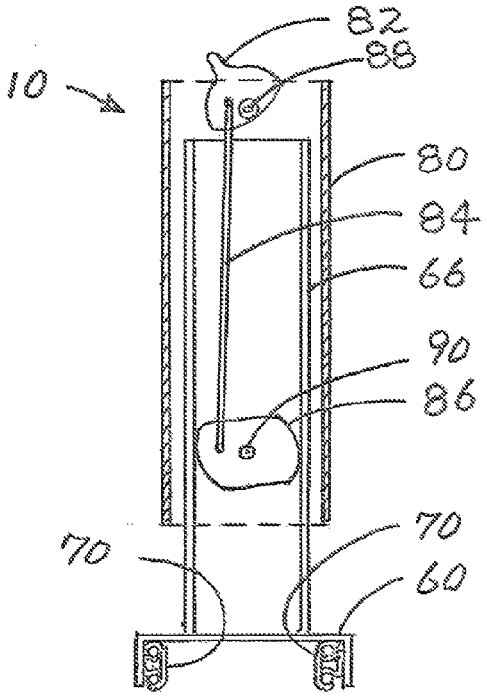
FIG. 28 is front view section of an embodiment of the vertical lock system in the locked position.
Figure 29:
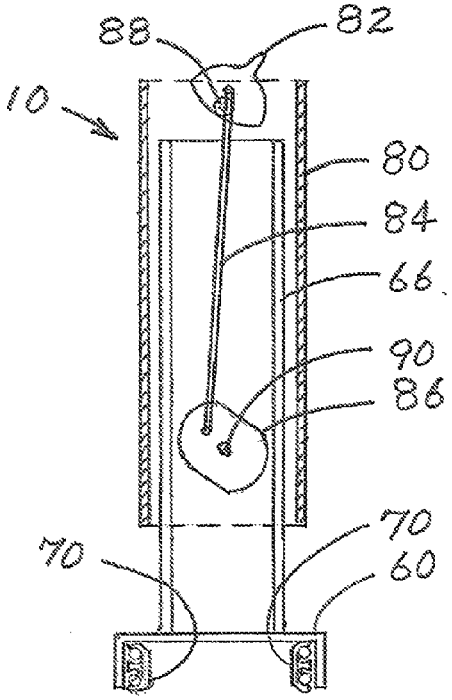
FIG. 29 is front view section of an embodiment of the vertical lock system in the unlocked position.
Figure 30:
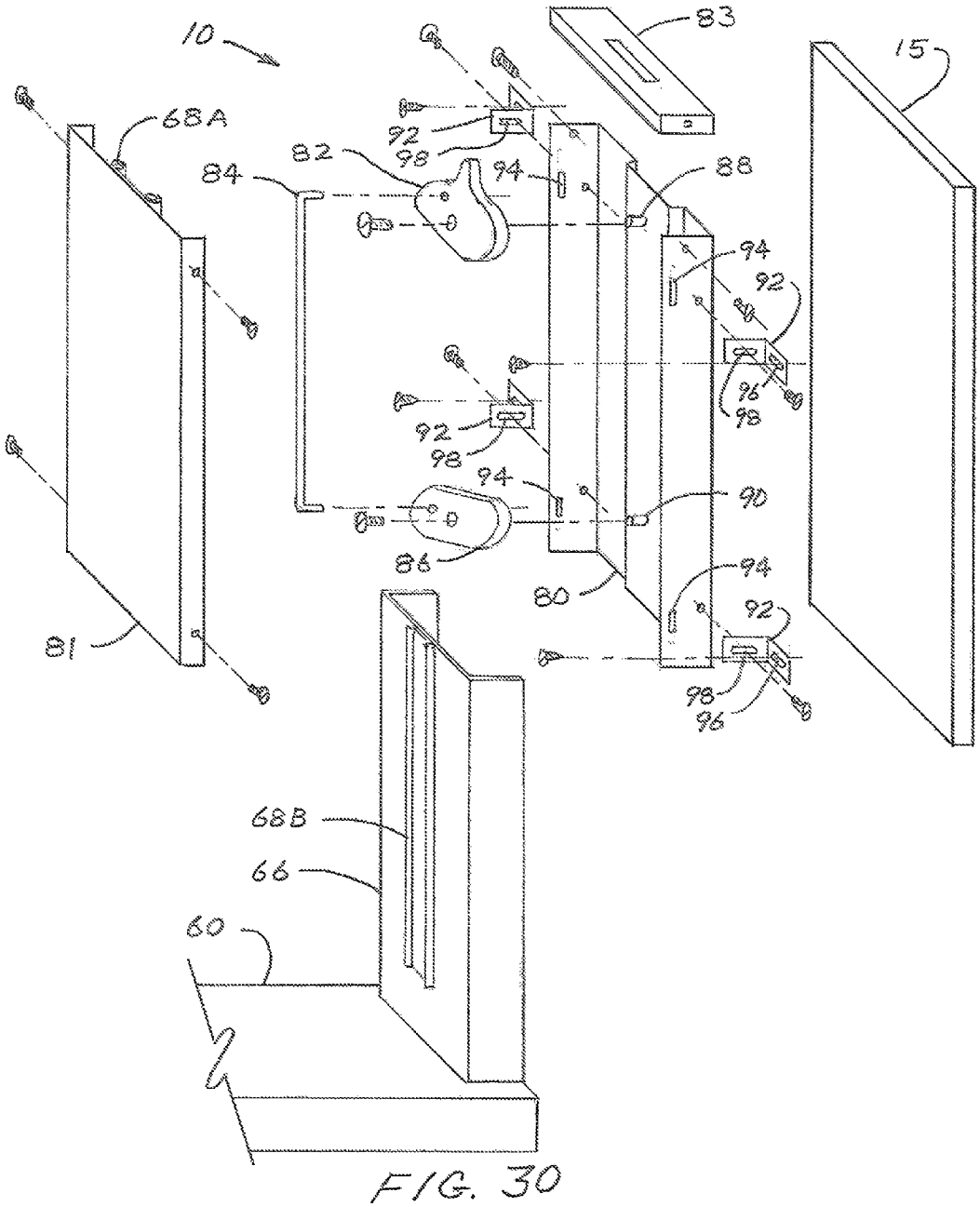
FIG. 30 is an exploded view of an embodiment of the vertical lock system.

FIGS. 28 and 29 illustrate one embodiment of the mechanics of the vertical lock system. In this embodiment, the vertical lock system is controlled, i.e. activated and deactivated by moving lock lever 82. Lock lever 82 rotates on lever pivot 88 and is attached to actuator 84. Actuator 84 is also attached to vertical brake 86. Vertical brake 86 rotates on lock pivot 90. Thus, movement of the controller, e.g. lock lever 82, engages/disengages vertical brake 86. When lock lever 82 is moved to the locked position, vertical brake 86 engages with the U-shaped sides of vertical frame 66 causing a friction braking action that stops vertical movement of the isolated vertical cabinet 13. The vertical lock system can be engaged when the isolated vertical cabinet 13 is at any height.

The vertical lock system illustrated in FIGS. 28 and 29 shows a simplistic braking system. More complex braking systems are also envisioned. Non-limiting examples include using a different controller such as a dial in place of lock lever 82; changing the location of the controller, e.g. mounting on the side; using multiple actuators 84; using multiple vertical brakes 86; using a multi-piece brake; using non-friction braking method (e.g. male/female, notches, etc.) and the like. Non-limiting examples of a multi-piece brake include brakes that can expand or contract via extension/folding/hinging; brakes having at least two parts that can move apart/together; and the like.

FIG. 26 illustrates an embodiment of a front panel 15 adjustment means, which can be incorporated into either the panel attachment sleeve 17 or the housing unit front 80. Panel mount bracket 92 has two slots, 96 and 98, that are roughly perpendicular to each other. Slot 96 allows for lateral side-to-side adjustment and slot 98 allows for in/out adjustment. Adjustment slots 94 allow for the up or down adjustment of either the housing unit front 80 and the vertical braking system or the panel attachment sleeve 17, the front panel 15, and the handle 14. In another embodiment, the two slots, 96 and 98, on the panel mount bracket 92 are connected to form one extended slot.

FIGS. 25, 26, 27, and 30, provide more details on how the vertical lock system and the lock housing unit attaches to and interacts with isolated vertical cabinet 13. In the embodiment illustrated, the lock housing unit partially surrounds vertical frame 66. Lock housing unit back 81 is fastened to isolated vertical cabinet 13. In other embodiments, lock housing unit back 81 may be part of or integrated with the isolated vertical cabinet 13. In the embodiment illustrated, vertical slide 68 has two parts, 68A and 68B, which slideably engage with each other. Part 68A is attached to lock housing unit back 81 and part 68B is attached to vertical frame 66. Vertical frame 66 is U-shaped with the majority of the vertical lock system, i.e. lock lever 82, actuator 84, and vertical brake 86, contained within the U-shape. Vertical brake 86 is sized and shaped to be able to engage/disengage with the U-shape of vertical frame 66. Lock housing unit front 80 attaches to lock housing unit back 81, with vertical frame 66 and most of the vertical lock system sandwiched in between. The lock housing unit cap 83 attaches to the top of the lock housing unit and allows a portion of lock lever 82 to pass through. In other embodiments the lock housing unit cap 83 is shaped to accommodate the shape of the controller of the vertical lock system. Front panel 15 is attached to lock housing front 80.

The above description and accompanying figures illustrate how retractable vertical cabinet 12 and isolated vertical cabinet 13 may be used to respectively lower and raise storage unit 10. This invention also contemplates the reverse, i.e. using retractable vertical cabinet 12 to raise a low storage or using isolated vertical cabinet 13 to lower an upper storage unit.

Although the foregoing invention has been described in some detail for purposes of clarity, it will be apparent that certain changes and modifications may be made without departing from the principles of the present invention. It should be noted that there are many alternative ways of implementing both the processes and apparatuses of the present invention. Accordingly, the present embodiments are to be considered as illustrative and not restrictive, and the invention is not to be limited to the specific details given herein.

Further, it will be understood that those skilled in the art, both now and in the future, may make various improvements and enhancements which fall within the scope of the claims which follow. These claims should be construed to maintain the proper protection for the invention first described.

What is claimed:

1. A storage system for storing contents, comprising:

a support frame having a horizontal section and at least one vertical section;

an isolated vertical cabinet comprising:

a first side and a second side;

at least a first pivoting support member having a first end and a second end; at least a first link having a first end and a second end; wherein the first end of the first pivoting support member is attached to the support frame; wherein the second end of the first pivoting support member is attached to the first end of the first link; wherein the second end of the first link is attached to the first side of the isolated vertical cabinet; and wherein the second side of the isolated vertical cabinet is opposite to the first side of the isolated vertical cabinet and is accessible for storing contents;

a lift adjuster slidably housed on the first pivoting support member;

a rotating adjustment screw threadably connected to the lift adjuster, the rotating adjustment screw including a first and a second idlers on each end allowing for movement of the lift adjuster along the second pivot support member;

a lift assist mechanism having a first end and a second end; wherein the first end of the lift assist mechanism is connected to the first pivoting support member and the lift adjuster and the second end of the lift assist mechanism is connected to the support frame; wherein the lift adjustor and the lift assist mechanism provide for a change in leverage as the lift adjuster moves substantially towards the first or the second end of the first pivoting support member providing assistance to the lift assist mechanism in movement of the isolated vertical cabinet;

wherein the support frame partially surrounds the isolated vertical cabinet; and a vertical lock system comprising:

a controller;

an actuator; and a brake;

wherein the actuator is connected to the controller and the brake; and wherein the brake engages and disengages with the at least one vertical section of the support frame to affect the movement of the storage cabinet along a vertical axis.

2. The storage system of claim 1, further including a second pivoting support member having a first end and a second end and a second link having a first end and a second end; wherein the first end of the second pivoting support member is attached to the support frame; wherein the second end of the second pivoting support member is attached to the first end of the second link; and wherein the second end of the second link is attached to the first side of the isolated vertical cabinet.

3. The storage system of claim 2, wherein the second end of the lift assist mechanism is attached to the second pivoting support member.

4. The storage system of claim 1, further comprising an electric actuator movement; wherein the electric actuator movement comprises:

a motor mounted to the support frame;

a swivel block connected to the first pivoting support member;

a rotating threaded shaft connected to and driven by the motor; wherein the threaded shaft rotates through the swivel block.

5. The storage system of claim 1, further including a safety stop; wherein the safety stop is attached to the horizontal section of the support frame in order to retain the isolated vertical cabinet in a fully down position.

6. The storage system of claim 1, wherein the support frame further comprising at least two vertical sections.

7. The storage system of claim 1, further comprising at least one stabilizer mechanism.

8. The storage system of claim 1, further comprising a locking mechanism.

9. The storage system of claim 8, wherein the locking mechanism is actuated upon vertical movement of the storage system.

10. The storage system of claim 1, further comprising a vertical slide.

11. The storage system of claim 1, further comprising a horizontal slide.

12. The storage system of claim 1, wherein the storage system includes at least a sidewall attached to the second side of the isolated vertical cabinet.

13. The storage system of claim 1, wherein the at least one vertical section of the support frame is roughly U-shaped.

14. The storage system of claim 13, wherein the brake and a portion of the actuator of the vertical lock system are located within the U-shape of the at least one vertical section of the support frame.

15. The storage system of claim 1, wherein the controller is a lever.

16. The storage system of claim 1, wherein the brake is a friction brake.

17. The storage system of claim 1, further comprising a front panel.

18. The storage system of claim 17, wherein the front panel is attached to the storage system with at least two fasteners each fastener having two slots that are perpendicular to each other; and wherein the fastener allows the front panel to be adjusted along two different planes.

19. The storage system of claim 17, wherein the front panel is attached to the same end of the storage system as the at least one vertical section of the support frame.

20. The storage system of claim 1, further comprising a fixed cabinet, wherein the storage system moves in and out of the fixed cabinet.

* * * * *